United States Patent [19]

Chapman et al.

[11] 4,261,027

[45] Apr. 7, 1981

[54] INCANDESCENT REFLECTOR LAMP FOR RAILWAY WARNING-SIGNAL APPARATUS

[75] Inventors: Lloyd E. Chapman, Allendale, N.J.; Dennis W. Pedley, Bath, N.Y.

[73] Assignee: Westinghouse Electric Corp., Pittsburgh, Pa.

[21] Appl. No.: 41,447

[22] Filed: May 22, 1979

[51] Int. Cl.[3] ..... F21M 3/14

[52] U.S. Cl. ..... 362/255; 362/309; 362/310; 362/311

[58] Field of Search ..... 362/255, 310, 300, 82, 362/309, 311

[56] References Cited

U.S. PATENT DOCUMENTS

| | | | |
|---|---|---|---|
| 1,735,572 | 11/1929 | Handlan | 362/367 |
| 4,213,171 | 7/1980 | Sassmannshavsen | 362/310 |

*Primary Examiner*—Stephen J. Lechert, Jr.

*Attorney, Agent, or Firm*—D. S. Buleza

[57] ABSTRACT

The separate reflector and light bulb components presently used in flashing-light signal apparatus employed at railway crossings are replaced by a sealed-beam type incandescent reflector lamp having a window-aperture in the concave reflector portion of the lamp envelope which is adapted to be aligned with a side opening in the lamp-housing of the signaling apparatus and thus permits the operation of the light source inside the sealed-beam lamp to be checked visually by the engineer of an approaching train. Additional cost and functional advantages are obtained by also making the separate red-colored lens component of the signal apparatus an integral part of the sealed-beam warning lamp and by using a long-life halogen-cycle type lamp component as the light source within the sealed-beam reflector envelope.

11 Claims, 6 Drawing Figures

INCANDESCENT REFLECTOR LAMP FOR RAILWAY WARNING-SIGNAL APPARATUS

BACKGROUND OF THE INVENTION

1. Field of the Invention

This invention generally relates to electric lamps and has particular reference to an improved incandescent reflector lamp that is suitable for use as the light source in warning-signal apparatus of the type employed at railroad crossings and the like.

2. Description of the Prior Art

As is well known, visual warning of an approaching train at railway crossings is provided by a flashing red light that is part of the signalling apparatus located at each crossing. In order to ensure that pedestrian and vehicular traffic see the warning light on bright sunny days when the ambient light level is very high, the warning light system must be such that it concentrates the light rays into a very narrow and intense beam of light that is directed toward the traffic. In addition, suitable means must be provided to permit the engineer of an approaching train to quickly and reliably determine whether the warning-signal lamp is actually operating properly.

In the railway-crossing signalling apparatus now in use, the aforesaid requirements are met by mounting a miniature incandescent light bulb in focussed relationship with a separate reflector within the housing of the signalling apparatus so that the light rays pass through a red-colored lens located on the front of the housing. Aligned openings in the sides of the lamp-housing and reflector component permit the train engineer to view the interior of the housing and thus visually verify that the light bulb and warning signal are operating normally as the train approaches the crossing.

Electric lamps that contain a light source which is disposed within a light-reflecting housing or enclosure are generally well-known in the art and have been used for many years, in the form of automobile sealed-beam headlamps for example. A headlamp having an outer parabolic reflector and a lens cover that are joined together and form a housing which contains a lamp bulb and an inner auxiliary reflector that has a pair of window-apertures which permit some of the light to strike the outer reflector and then pass through the lens in order to provide a beam pattern which makes efficient use of the total light flux emitted by the lamp bulb is disclosed in U.S. Pat. No. 3,184,592 granted May 18, 1965 to P. Cibie.

An electric lamp assembly that is designed for use in a light projector and consists of an outer bulb of light-transmitting material (such as "strengthened" glass) which encloses a halogen-type electric lamp bulb and is provided with a plurality of heat-radiating holes or "pores" is disclosed in Japanese Pat. Publication No. 49-28380 published Mar. 11, 1974 and granted to C. Kotake.

SUMMARY OF THE INVENTION

While the prior art railway-crossing signalling apparatus is satisfactory from a functional standpoint since it provides the required intense flashing-warning light and permits train engineers to visually determine whether the apparatus is actually working properly, the three-piece optical system (consisting of the miniature incandescent lamp bulb and separate reflector and red-colored lens components) is expensive and difficult to maintain and service. Insofar as the incandescent bulb must be positioned in focussed relationship with the reflector, relamping of the prior art signalling apparatus has to be done by skilled maintenance personnel to ensure that the device is adjusted correctly and operates properly. In addition, the miniature incandescent lamp bulbs presently used as the light source in conventional signalling apparatus inherently have poor lumen maintenance characteristics due to the small size of the bulb and the fact that it progressively blackens as the bulb burns.

The present invention provides a very practical and economical solution to all of the foregoing problems and disadvantages by replacing the separate lamp-and-reflector optical assembly with a sealed-beam type incandescent lamp that has a novel integral reflector means which provides a window aperture that is so oriented that it is automatically aligned with the side opening in the housing of the signalling apparatus (when the reflector lamp is mounted within the housing) and thus permits train engineers to visually check the condition of the warning light in the same manner as is now done with conventional signalling equipment.

In accordance with a preferred embodiment of the invention, the integral reflector means of the sealed-beam warning lamp comprises a mirror-like coating of aluminum or similar metal on the inner surface of a paraboloidal glass member and selected portions of the glass member are left uncoated to provide a pair of spaced window-apertures into the interior of the sealed-beam lamp. While the light source within the reflector lamp can consist of a conventional filament of coiled tungsten wire, a more efficient sealed-beam warning lamp can be provided by mounting a halogen-cycle type incandescent lamp component within the reflectorized outer envelope. Such a lamp unit will also have a much longer useful life and thus further reduce maintenance costs. If desired, the separate red-colored lens now employed in conventional railway signalling apparatus can also be made an integral part of the sealed-beam warning lamp of the present invention by fabricating it from suitable material so that the latter will comprise a completely self-contained optical system and replace the costly three-component system now being used.

As will be apparent to those skilled in the art, since the coiled filament (or halogen lamp component) of the improved railway-crossing reflector lamp is mounted in precise prefocussed relationship with the reflector surface of the sealed-beam envelope, it will be automatically positioned correctly when the lamp is placed within the housing of the warning-signal apparatus. Of course, suitable minor modifications will be required in the housing to accommodate the sealed-beam lamp and ensure that it is properly mounted and oriented within the signalling device. The sealed-beam optical system provided by the improved warning lamp is thus very efficient and reliable and also reduces maintenance costs since the lamps can be quickly replaced as they burn out without any need for the time-consuming adjustments and manual focussing operations now required. The signalling apparatus is accordingly not only provided with a "new" optical system every time it is relamped but the sealed beam construction of the reflector warning lamp also prevents dirt and moisture from contaminating the optical system and reducing its efficiency. The rail-crossing signal lamp of the present invention thus provides built-in safeguards against poorly maintained and poorly illuminated warning signals which could constitute a safety hazard.

BRIEF DESCRIPTION OF THE DRAWINGS

A better understanding of the invention will be obtained from the exemplary embodiments shown in the accompanying drawings, wherein.

DESCRIPTION OF THE PREFERRED EMBODIMENTS

Figure 1:
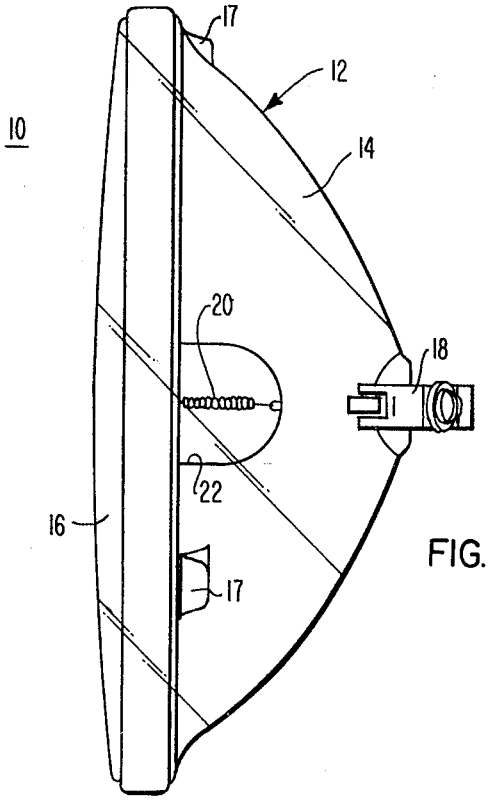
FIG. 1 is a side-elevational view of a sealed-beam reflector type warning-signal lamp embodying the present invention.
Figure 2:
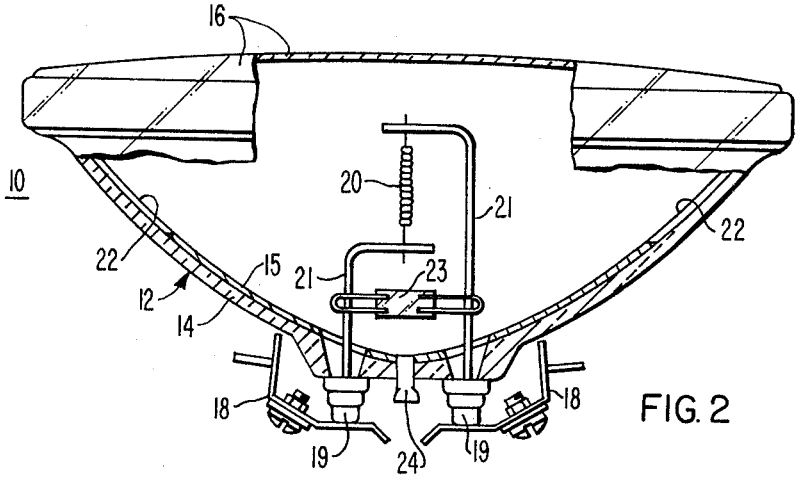
FIG. 2 is a cross-sectional view of the reflector lamp shown in FIG. 1 illustrating the internal structure of the lamp.
Figure 3:
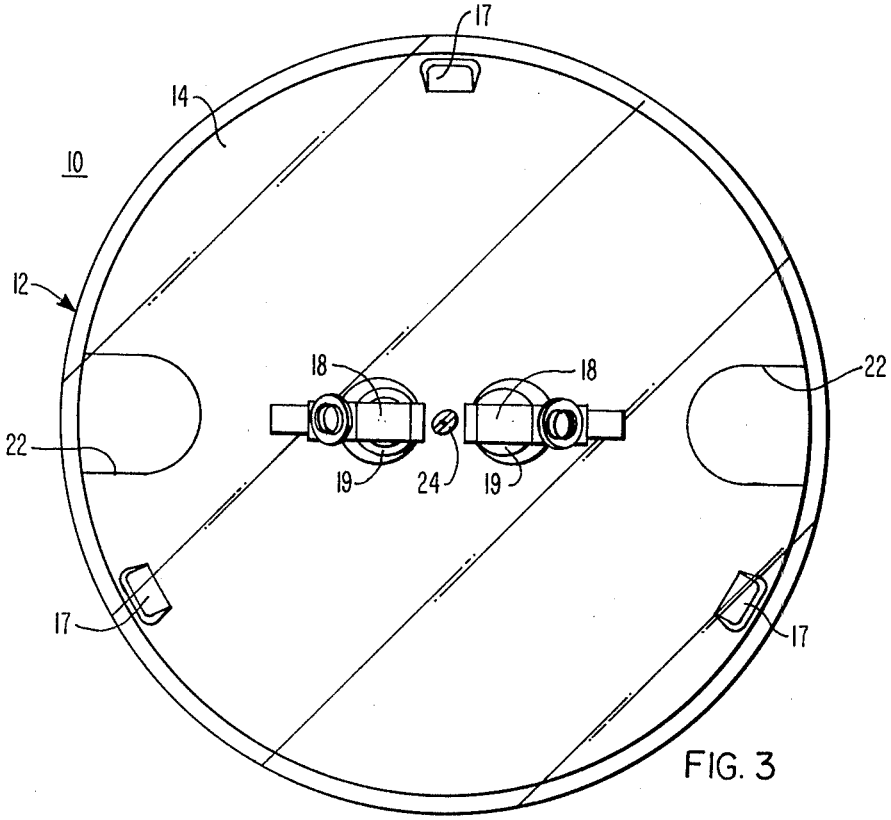
FIG. 3 is a plan view of the back of the reflector lamp shown in FIGS. 1 and 2.

In FIGS. 1–3 there is shown an improved rail-crossing signal lamp 10 which embodies the present invention and consists of an envelope 12 that is formed by a concave member 14 and a light-transmitting cover or lens member 16 that is secured to the periphery of the concave member closes such member. As will be noted in FIG. 2, the inner surface of concave member 14 is provided with a layer of highly reflective material such as a thin coating 15 of aluminum or other metal which forms a mirror-like surface and thus serves as an integral reflector means for the lamp 10. While the concave member 14 and lens member 16 can be fabricated from various kinds of material that will withstand the temperatures and environment to which the lamp 10 will be subjected when in use within the railway-signalling apparatus, they are preferably fabricated from hard glass and are fused to one another along their matching peripheries to form a sealed-beam envelope 14 of the type commonly used for automobile headlamps.

As illustrated, particularly in FIG. 3, the concave reflectorized component 14 is provided with suitable means such as three spaced projections or lugs 17 that are adapted to interfit with suitable recesses or other means in the lamp-housing portion of the warning-signal apparatus and thus automatically orient the reflector lamp 10 in proper operative relationship when it is placed within and coupled to the housing. Suitable electrical terminal means such as blade-like connectors 18 with screw-elements are secured to the back of the concave reflector member 14 by brazing or otherwise fastening them to metal ferrules 19 that are sealed into openings provided in the concave glass member. Such connectors are particularly suitable since they mate with the existing wiring in the signalling devices.

As shown in FIGS. 1 and 2, a suitable light source such as a coiled filament 20 of tungsten wire or similar refractory metal is disposed in central position within the sealed envelope 12 and is supported in such position by a pair of lead-in conductors such as wires 21 that are secured to the ends of the filament and are fastened to the respective ferrules 19. The mount structure formed by the coiled filament 20 and connected lead-in wires 21 preferably also includes a suitable bridge component 23 which, as shown in FIG. 2, can consist of an insulator and a pair of wire loops that are anchored in the insulator and welded to the respective lead-in wires. In order to provide an intense concentrated beam of light, the concave reflectorized glass member 14 is preferably of paraboloidal configuration and the coiled filament 20 extends along the axis of the parabolic reflector surface provided by the metal coating 15 and is substantially centered so that its midpoint is at the focal point of the reflector surface.

In accordance with the present invention, selected portions of the concave glass member 14 are not coated with the reflective metal film 15 and thus provide a pair of clear light-transmitting window-apertures 22 (shown in FIGS. 1–3) that are located 180° apart on either side of the filament coil 20. These window-apertures 22 are so oriented relative to the positioning lugs 17 that they are automatically aligned with the side-openings in the lamp housing (not shown) of the signalling apparatus when the reflector lamp 10 is mounted in assembled relationship within the apparatus. The engineer of an approaching train will accordingly have a direct view into the sealed-beam envelope 12 and can readily see whether the reflector lamp 10 is functioning properly within the signalling apparatus.

If the reflector film 15 is made by vaporizing aluminum or other suitable metal onto the inner surface of the parabolic glass member 14, then the required window-apertures 22 can be readily formed by simply masking the selected side portions of the glass parabolic member 14 during the reflectorizing operation. While the coiled filament 20 is visible through the window-apertures 22 according to this embodiment (as shown in FIG. 1), such positioning of the filament is not required to permit a reliable visual check for "burned out" lamps since the direct view into the interior of the lighted lamp 10 provided by either of the window-apertures 22 will immediately notify the observer that the lamp is actually operating, even though the filament itself may be positioned deep within the reflectorized component 14 and thus not be directly exposed to view.

In accordance with the usual practice in manufacturing sealed-beam type headlamps, the envelope 12 is evacuated and filled with a suitable inert gas such as a mixture of argon and nitrogen at a pressure of about one atmosphere through a suitable tubulation 24 (FIGS. 2 and 3) provided on the back of the concave reflector member 14, which tubulation is then tipped-off and hermetically sealed in the customary manner.

Excellent results have been obtained with prototype warning-signal lamps embodying the modified sealed-beam reflector construction of the present invention by employing tungsten filament coils designed to operate at 10 volts and 25 watts and mounting them within a hard glass PAR 64 type envelope formed by a clear lens and a paraboloidal aluminum-reflectorized concave member of circular configuration having a nominal diameter of 8⅛ inches (206 mm.). The overall length of the lamp (including the terminal connectors) was approximately 4 inches (102 mm.). The lamp had an initial light output of approximately 310 lumens, produced a concentrated light beam that had an initial maximum beam candlepower of 90,000 candelas, and had a design life of 2,000 hours.

As will be apparent to those skilled in the art, the invention is not limited to warning lamps that have all-glass reflector-coated envelopes. For example, the concave member can be made of a metal such as aluminum that has a mirror-like finish on its inner surface and is provided with cut-outs that are closed by glass inserts which form the required light-transmitting window-apertures. The cover member can also be bonded (as with a suitable cement) to the metal (or glass) concave member to form the closed outer envelope.

ALTERNATIVE LAMP EMBODIMENT (FIG. 4)

Figure 4:
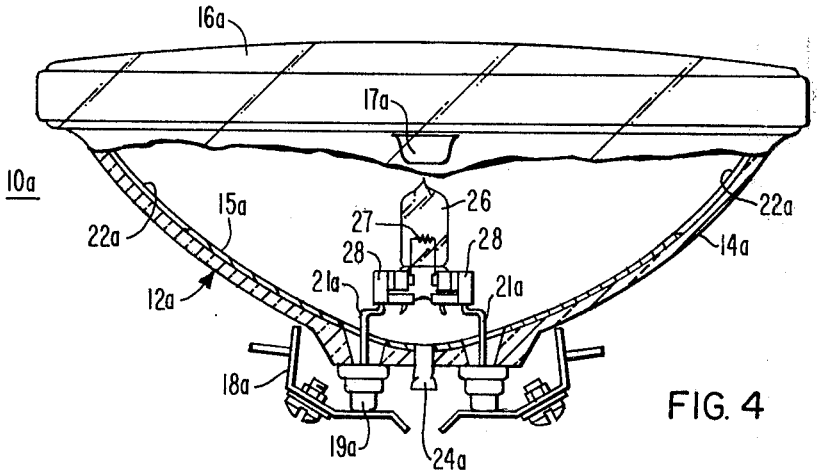
FIG. 4 is a side-elevational view, partly in section, of an alternative reflector type warning lamp which employs a halogen-cycle lamp bulb as the light source in place of the coiled filament used in the previous embodiment.

The improved integral-reflector warning-signal lamp of the present invention is not limited to sealed-beam lamps which contain a "bare" coiled filament but includes within its scope sealed-beam reflector lamps which employ a compact halogen-cycle lamp component as a light source. A lamp embodiment 10*a* of this type is shown in FIG. 4 and, as illustrated, employs an hermetically-sealed envelope 12*a* that is formed by a reflectorized concave member 14*a* and a lens member 16*a* that are made from hard glass and fused together along their peripheries as in the previously-described embodiment. The envelope 12*a* accordingly is provided with transparent window-apertures 22*a* as well as terminal connectors 18*a* that are secured to metal ferrules 19*a* which are fastened to a pair of lead-in wires 21*a* that protrude into the envelope.

In accordance with this embodiment, a compact halogen-cycle type lamp 26 containing a halogen atmosphere and a tungsten filament 27 is mounted in prefocussed relationship with the parabolic reflector surface provided by the specular metal film 15*a* on the concave glass member 14*a*. The halogen lamp 26 is held in such position by suitable means such as a pair of metal clips 28 that are slipped over and grip the sides of the press-sealed end of the tubular lamp envelope and are welded to the respective rigid lead-in wires 21*a* and a pair of leads that extend from the sealed end of the halogen lamp.

Since the coiled filament 27 is disposed within the sealed tubular envelope of the halogen lamp 26, the outer sealed-beam envelope 12*a* which is formed by the concave member 14*a* and lens member 16*a* can either be evacuated through the tubulation 24*a* and left in this condition, or it can then be filled with a suitable non-oxidizing atmosphere such as nitrogen if desired. Alternatively, the outer envelope need not be hermetically sealed but can be merely "closed" to prevent the ingress of moisture and dirt but admit air.

FLUTED-LENS REFLECTOR LAMP EMBODIMENT

(FIGS. 5-6)

Figure 5:
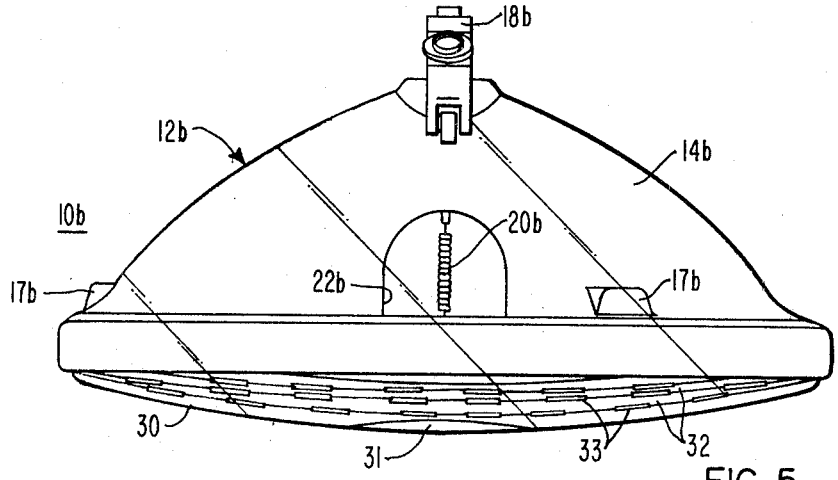
FIG. 5 is a side-elevational view of still another reflector warning-signal lamp embodiment in which the light-controlling red-colored lens component of the prior art signalling system is incorporated as an integral part of the lamp.

In accordance with still another embodiment of the invention, shown in FIG. 5, the sealed-beam reflector type railway-warning lamp 10*b* is provided with a lens component 30 that is composed of red-colored glass and has a plurality of integral light-bending elements which concentrate the light rays into an intense concentrated beam pattern and thus replaces the separate lens component presently used in conventional railroad-crossing warning-signalling apparatus. The reflector lamp 10*b* is constructed in the same manner as the lamp shown in FIGS. 1-3 and thus contains a suitable light source (such as a coiled filament 20*b* ) and includes a reflectorized concave member 14*b* that is provided with positioning lugs 17*b*, window apertures 22*b*, terminal connectors 18*b*, etc.

As will be noted in FIG. 5 (and more clearly in FIG. 6), a typical colored lens component 30 has a centrally-located "bulls eye" 31 that is almost entirely devoid of light-bending elements. The remaining portion of the lens has a series of diametrically-extending flutes 32 and spaced rectangular-shaped prismatic facets 33 which, together with the flutes, are optically contoured and arranged to direct the light rays produced by the light source into a concentrated beam of light that can be easily seen by pedestrian and vehicular traffic at the railway crossing under all ambient-light conditions. The aforesaid flutes 32 and auxiliary light-modifying elements 33 are preferably located on the inner surface of the lens component 30 so that the exposed surface of the latter is smooth and thus remains substantially free of dirt and other contaminants when the lamp is in use in the signal device.

Figure 6:
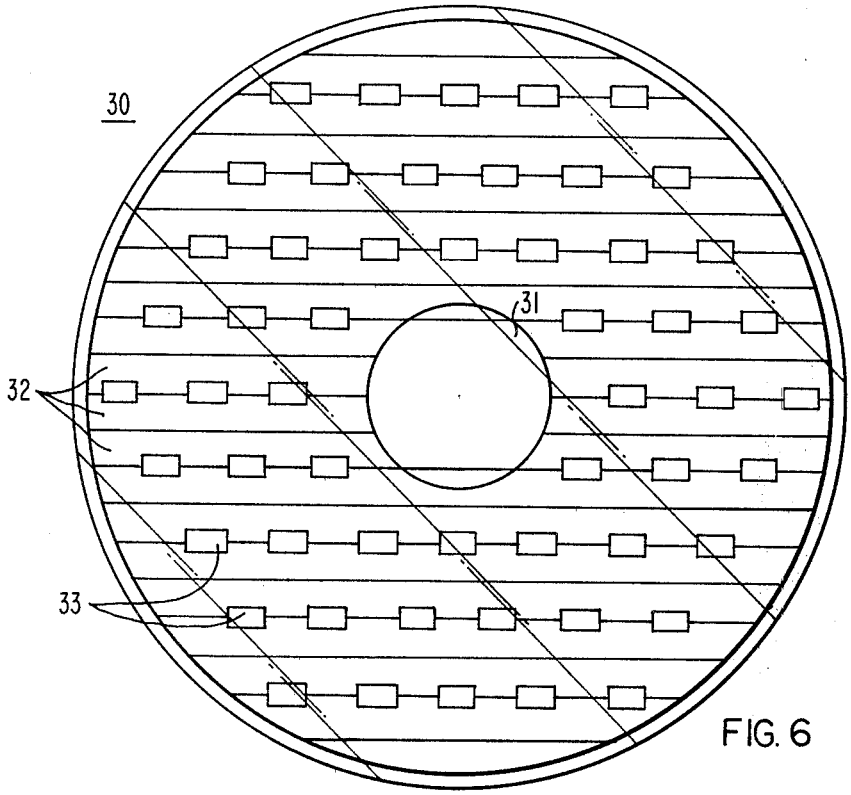
FIG. 6 is a plan view of the fluted lens component employed in the lamp embodiment of FIG. 5.

For convenience in illustrating this particular embodiment in the drawings, the reflector lamp 10*b* and its fluted lens component 30 are shown in FIGS. 5 and 6, respectively, displaced 90° from the positions in which they are actually used in the warning-signalling apparatus. Hence, the lens 30 will face in a forward direction and the flutes 32 will extend vertically when the lamp 10*b* is mounted within the signaling device, with the window apertures 22*b* located at each side of the sealed-beam envelope 12*b* and abreast of the filament 20*b*.

We claim as our invention:

1. An electric lamp that is adapted for use as a readily replaceable light source in warning-signal apparatus of the type employed at railway crossings and the like, which apparatus includes a lamp-housing having a side-opening therein that is so oriented that it affords the engineer of an approaching train a direct view into the interior of the lamp-housing and thus provides means for visually determining whether the light source and the warning-signal apparatus are functioning properly, said electric lamp comprising;

an envelope having a concave portion and a light-transmitting portion that extends across and closes said concave portion, means within said envelope for generating light when the electric lamp is energized, lead-in conductor means extending into said envelope and connected to the light-generating means, and integral reflector means associated with the concave portion of the lamp envelope comprising a material which provides a specular mirror-like surface that is disposed to intercept and reflect light rays that are produced by said light-generating means, a selected part of the concave portion of said lamp envelope being devoid of reflector material and also being light transmitting and thereby constituting a window-aperture that is adapted to be aligned with the side-opening in the lamp-housing of the warning-signal apparatus, when the electric lamp is in assembled relationship with said apparatus, so that said window-aperture by virtue of its location provides means for viewing the interior of the lamp envelope and thus visually determining the condition of the light-generating means therein when the electric lamp is in use within the energized warning-signal apparatus.

2. The electric lamp of claim 1 wherein said integral reflector means comprises a layer of light-reflective metal carried by the concave portion of the lamp envelope.

3. The electric lamp of claim 2 wherein said reflective-metal layer is located on the inner surface of the concave portion of the lamp envelope.

4. The electric lamp of claim 2 wherein the concave portion of said lamp envelope is composed of vitreous material.

5. The electric lamp of claim 4 wherein the light-transmitting closure portion of the lamp envelope is also composed of vitreous material and is hermetically joined to the concave portion and forms therewith an hermetically-sealed envelope.

6. The electric lamp of claim 5 wherein the concave and closure portions of said envelope comprise a pair of vitreous components that are fused to one another along their peripheries and said electric lamp is thus of the sealed-beam reflector type.

7. The sealed-beam warning-signal reflector lamp of claim 6 wherein the concave vitreous component of the lamp envelope is of generally paraboloidal configuration.

8. The sealed-beam warning-signal reflector lamp of claim 6 wherein said light-generating means comprises a coiled filament of refractory metal wire.

9. The sealed-beam warning-signal reflector lamp of claim 6 wherein said light-generating means comprises a compact halogen-cycle type incandescent lamp component.

10. The warning-signal reflector lamp of claim 5 wherein the vitreous closure portion of the lamp envelope comprises a lens member that has integral light-bending elements which are oriented and contoured to concentrate the transmitted light rays into a beam pattern of predetermined configuration and intensity.

11. The warning-signal reflector lamp of claim 10 wherein said lens member is composed of colored glass and said light-bending elements comprise flutes and prismatic elements that are defined by the inner face of the lens member.

* * * * *